United States Patent [19]

Takao et al.

[11] Patent Number: 4,653,991

[45] Date of Patent: Mar. 31, 1987

[54] VANE TYPE COMPRESSOR WITH FLUID PRESSURE BIASED VANES

[75] Inventors: Kunihiko Takao; Kenichi Kawashima; Yozo Nakamura, all of Ibaraki, Japan

[73] Assignee: Hitachi, Ltd., Tokyo, Japan

[21] Appl. No.: 710,424

[22] Filed: Mar. 11, 1985

[30] Foreign Application Priority Data

Mar. 14, 1984 [JP] Japan ..... 59-47011

[51] Int. Cl.[4] ..... F04C 18/00; F04C 29/02

[52] U.S. Cl. ..... 418/82; 418/93; 418/268

[58] Field of Search ..... 418/76, 82, 93, 99, 418/268

[56] References Cited

U.S. PATENT DOCUMENTS

| | | | |
|---|---|---|---|
| 2,455,297 | 11/1948 | Curtis et al. | 418/93 |
| 3,781,145 | 12/1973 | Wilcox | 418/1 |
| 4,071,306 | 1/1978 | Calabretta | 418/93 |
| 4,498,853 | 2/1985 | Sakamaki et al. | 418/268 |

FOREIGN PATENT DOCUMENTS

| | | | |
|---|---|---|---|
| 2262814 | 6/1974 | Fed. Rep. of Germany | 418/82 |
| 58-104381 | 7/1983 | Japan | 418/93 |

*Primary Examiner*—John J. Vrablik

*Attorney, Agent, or Firm*—Antonelli, Terry & Wands

[57] ABSTRACT

The compressor is characterized by a high pressure port provided in a rear plate at a position that the bottom portion of a vane groove of a vane which reaches a delivery port contacts the high pressure port, and low pressure ports provided, independently of the high pressure port, in the front and rear plates at positions so that the low pressure ports communicate with the high pressure port through the bottom portion of the vane groove of the vane between the low and high pressure ports only when the center of said vane groove is disposed between the high and low pressure ports so that the high pressure is fed intermittently to the low pressure port. In a region of rotation of the rotor where vane-tip pressing force is small, a high pressure from the high pressure port is applied to vane grooves as vane back pressure, and in the other region a relatively low pressure is applied thereto from the low pressure ports.

8 Claims, 13 Drawing Figures

VANE TYPE COMPRESSOR WITH FLUID PRESSURE BIASED VANES

BACKGROUND OF THE INVENTION

This invention relates to a vane type compressor used for an automobile air-conditioner, and more particularly to a means for controlling the back pressure of vanes, which is suitably used to improve the performance and durability of such compressors.

In general, a vane type compressor is provided with a rotor on which a plurality of vanes are mounted so as to be movable outward and inward in vane grooves formed in the rotor. This rotor is disposed in a fixed cam ring, so that the vanes slide on the inner surface of the cam ring. Front and rear plates are disposed on both sides of the rotor. A plurality of independent compression chambers are defined by these plates, the inner surface of the cam ring, the outer surface of the rotor and adjacent vanes. The compression chambers change in volume as the rotor rotates, whereby suction and subsequent compression are conducted.

When this compressor is used for a refrigeration cycle, a coolant fed back to the compressor flows into the compression chambers via a suction port formed in the front plate. The coolant which is compressed there to a discharge pressure is discharged into a pressure chamber including therein an oil separator via delivery or discharge ports and discharge valves provided on the cam ring. Only coolant from which oil is separated by the oil separator is delivered to the refrigeration cycle.

The oil (lubricating oil) which is separated from the coolant in the oil separator and which is under the discharge pressure is temporarily stored in a bottom portion of the chamber and then introduced in a pressure-reduced state into a bottom portion of each vane groove due to a difference between the internal pressures in the pressure chamber and compression chamber via an oil supply passage and a spiral throttle inserted therein. The oil in the bottom portion of each vane groove is supplied as a lubricating oil for sliding parts of the compressor, and also as the force (which will hereinafter be referred to as the vane back pressure) for pressing the vanes against the inner circumferential surface of the cam ring, that is, the cam face. Accordingly, the contact pressure of the vanes against the cam face is obtained owing to the force based on the vane back pressure, the force of a gas working on the ends of the vanes and the inertial force, such as the centrifugal force occurring due to the rotation of the rotor. When the rotational speed of the compressor and the pressure conditions therein are constant, all the vanes are pressed against the cam face at the same back pressure. If the vane pressure is constant, the vane tip-pressing force Ft varies depending upon an angle $\theta R$ of rotation of the rotor which is measured from the mid-point of one of a pair of arc portions of the cam face which are positioned symmetrically with respect to its center. For example, when a ratio of the vane back pressure Pb to the discharge pressure Pd in the compressor, i.e. Pb/Pd is 0.5, Ft, which is at a substantially constant level when the angle $\theta R$ of rotation of the rotor is not more than 130°, decreases suddenly when $\theta R$ exceeds 130°. When $\theta R$ is in the vicinity of 160°, at which a vane end comes to the discharge ports of the cam ring, Ft increases suddenly. When $\theta R$ further increases, Ft decreases. When Pb/Pd is 0.5, Ft is not negative, i.e., the vane is not separated from the cam ring. However, when $\theta R$ is less than 130°, Ft may be as high as 9 kg.f, so that frictional loss at the vane end is relatively high. This causes the shaft input in the compressor to increase. Therefore, to reduce frictional loss, it is preferable to reduce Ft by setting Pb/Pd at a lower level. If Pb/Pd is reduced simply, for example, if Pb/Pd is set to 0.43, $Ft \approx 0$ when $\theta R = 158°$, and $Ft < 0$ when $173° \leqq \theta R \leqq 180°$. In this case, the vane end is separated from the cam ring, and this so-called chattering phenomenon occurs. When this chattering phenomenon occurs, abnormal sounds occur. Moreover, the vanes and cam ring wear abnormally, and the high-pressure gas in a preceding compression chamber defined by the adjacent vanes flows back to a subsequent compression chamber defined by different adjacent vanes, so that the adiabatic efficiency of the compressor as a whole decreases.

Means for preventing vane separation from a cam face in a vane pump is disclosed in U.S. Pat. No. 3,781,145, in which the vane separation is prevented by causing, by the inward movement of a vane in the vane groove, fluid in a vane groove bottom portion to flow through orifices formed in the vane and by creating thereby a higher pressure at the inner end of the vane than at the outer end. Differential pressure between the pressure at the inner end and that at the outer end of the vane presses the vane tip surely on the cam face thereby preventing chattering. Further, the patent discloses a relief port, formed in a front plate for limiting undesirable vane force and resultant undesirable wear, which communicates with the inner end of the vane groove in the region in which excessive or unnecessary pressure would otherwise exist, and limits the vane separation prevention force in a limited region.

According to the U.S. patent, it is necessary to form precise orifices in every vane as shown in FIG. 2, which makes the vanes complicated in construction and not easy in manufacturing.

SUMMARY OF THE INVENTION

The present invention has been developed with a view to improve a conventional compressor of this kind which has the above-mentioned faults. An object of the present invention is to provide a vane type compressor, which is provided with a compact and simply-constructed means for properly controlling vane back pressure, and which provides both high performance and high reliability.

The present invention is characterized in that a high pressure is applied, through a high pressure port, into bottom or lower portions of vane grooves only in a rotation angle region of the rotor in which the vane tip or end-pressing force Ft is extremely small, and a reduced pressure from the high pressure port is supplied into the lower portions of the vane grooves in a rotation angle region of the rotor, in which Ft is relatively high, through a low pressure port intermittently brought into communication with the high pressure port by the vane groove lower portions of the vanes coming into the vicinity of a delivery of discharge port formed in the cam ring.

According to the present invention, the vane back pressure is raised in a rotation angle region in which Ft is extremely small so that chattering phenomenon can be prevented, and lowered in most of the other rotation angle region by the switching effect of the vane groove lower portions, whereby vane tip frictional loss and compressor shaft input can be reduced.

DESCRIPTION OF THE PREFERRED EMBODIMENTS

An embodiment of the present invention will now be described with reference to the accompanying drawings.

Figure 1:
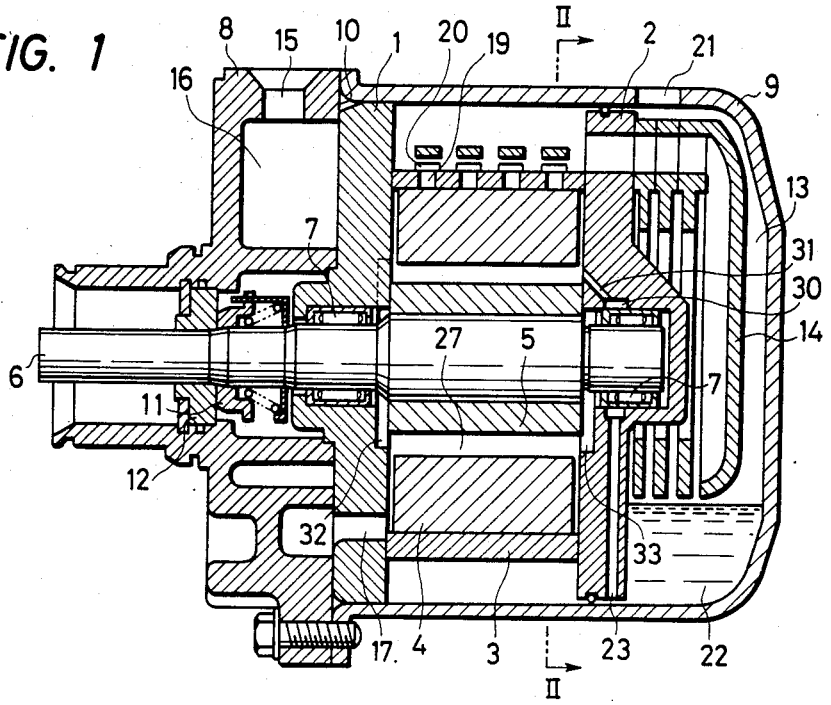
FIG. 1 is a sectioned side elevation showing an embodiment of a vane type compressor according to the invention.

FIG. 1 shows a vane type compressor comprising a chamber defined by a pair of side plates or front and rear plates 1, 2, and a cam ring 3 fastened between these plates 1, 2 by bolts (not shown), a rotor 5, which has a plurality of outward and inward-movable vanes 4, and which is fixed to a driving shaft 6. The shaft 6 is mounted on the central portion of the compressor in such a manner that the rotor 5 can be rotated with the driving shaft 6. The driving shaft 6 is supported on the front and rear plates 1, 2 via needle bearings 7. The front and rear plates 1, 2 and the cam ring 3 are fixed to a front cover 8 by through bolts (not shown) and covered with a rear cover 9 forming a chamber. The joint portion of the front cover 8 and the rear cover 9 is kept air-tight by an O-ring 10, and a rotary member 11, mounted fixedly on the driving shaft 6, and a cover plate 12, fixed to the front cover 8, constitute a shaft seal. A space 13 or a pressure chamber is formed at the rear side of the rear plate 2 and provided therein with an oil separator 14 which extends so as to surround a rear portion of the rear plate 2.

Figure 2:
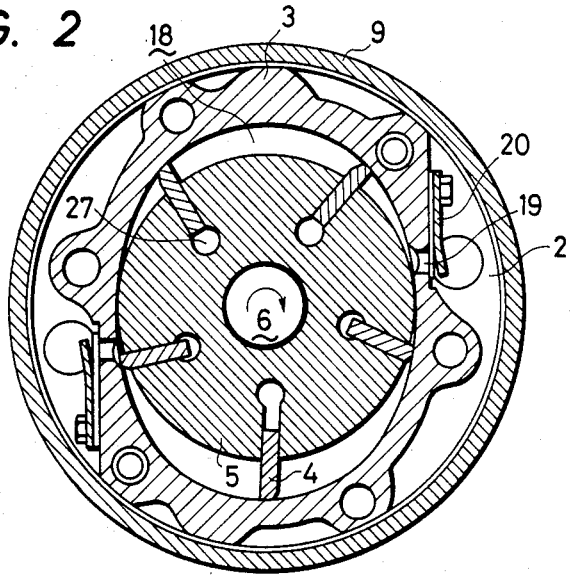
FIG. 2 is a sectional view taken along the line 2—2 in FIG. 1.

A fluid, for example, a coolant fed back from a refrigerating cycle to the compressor flows from a suction inlet 15, which is formed in the front cover 8, of the compressor into a low-pressure passage 16 formed in the front cover 8. The coolant then passes through a suction port 17, which is provided in the front plate 1, and flows into a compression chamber 18 which is defined by two adjacent vanes as shown in FIG. 2, the outer circumferential surface of the rotor and the inner circumferential surface or cam face of the cam ring 3. The volume of the compression chamber first varies from zero to a maximum level as the driving shaft 6 rotates, to complete a suction stroke. The driving shaft further rotates to cause the volume of the compression chamber to decrease gradually from the maximum level and thereby make a compression stroke. The coolant thus compressed to attain a discharge pressure is discharged into the oil separator 14 via discharge ports 19 and discharge valves 20 which are provided in and on the cam ring 3 as shown in FIG. 1. In the oil separator 14, the oil is separated from the coolant, and the coolant alone is sent under pressure from a discharge port 21, which is provided in the rear cover 9, of the compressor to the refrigeration cycle. The oil (lubricating oil) 22 which is separated from the coolant in the oil separator 14 and which is under the discharge pressure is temporarily stored in a bottom portion of the pressure chamber 13.

A high-pressure oil supply passage 23 is formed in a rear plate 2, communicated with the lubricating oil 22 and opened into an annular communication passage 30 provided around the outer circumference of a needle bearing 7. High-pressure ports 31, which are communicated with the communication passage 30, are also formed in the rear plate 2. The rear plate 2 and the front plate 1 are provided with low-pressure ports 33, 32, which are formed so as to contact the bottom portions of vane grooves 27 provided in the rotor 5.

Figure 3:
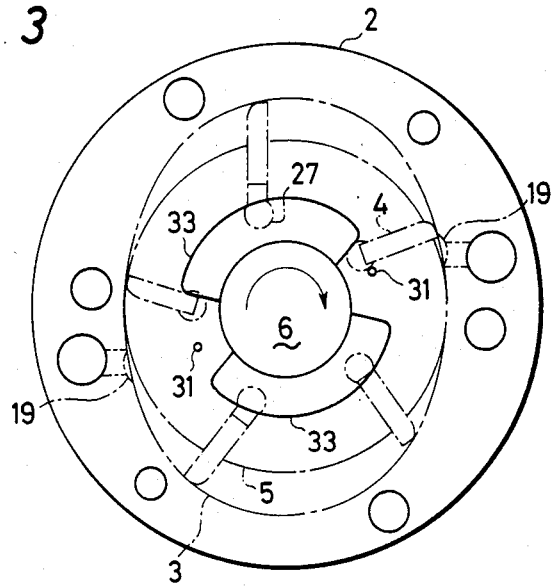
FIGS. 3 and 4 are plan views of a rear plate and a front plate, respectively.
Figure 4:
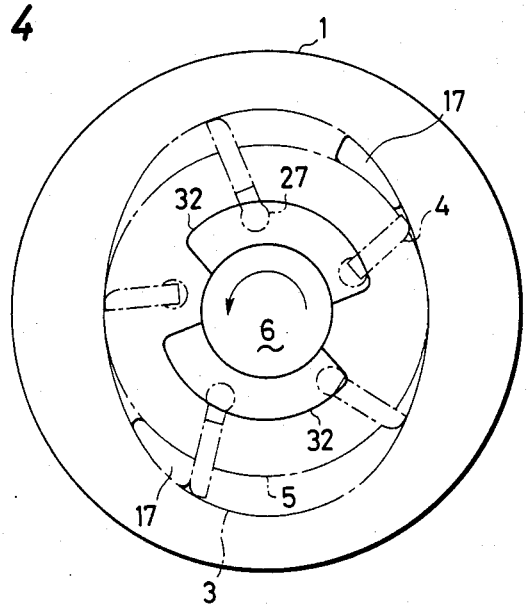

FIGS. 3 and 4 show the shapes and positions of the high-pressure ports 31 and low-pressure ports 33, 32 which are formed in the rear and front plates 2, 1. In FIG. 3, each of the high-pressure ports 31 formed symmetrically of the driving shaft 6 in the rear plate 2 is positioned in the portion thereof in which the bottom portion of a vane groove 27 starts to communicate with the high-pressure port when the end of a vane 4 comes to a discharge port 19 in the cam ring 3. Accordingly, in a region of an angle of rotation of the rotor, in which the vane tip-pressing force may be negative if there is not provided the high pressure port 31, a high pressure is temporarily applied as a back pressure to the vane 4 since the bottom portions of the vane grooves 27 are communicated with the high-pressure ports 31, so that the vane tip-pressing force becomes positive. As a result, the vane 4 can pass the high-pressure port 31 smoothly without being separated from the cam face.

Each of the low-pressure ports 32, 33 formed in the front and rear plates 1, 2 is formed in the shape of a fan so that one of the ports 32 and one of the ports 33 are in symmetrical positions with respect to the other, with respect to the axis of a driving shaft 6. First, a starting position of the low-pressure port 33 in the rotational direction of the rotor 5 will be described. In general, the portions of the cam face of the cam ring 3 which are closest to the outer circumferential surface of the rotor 5 are provided with arcuate parts, for example about 10° of rotational angle, which have a diameter slightly larger than the outer diameter of the rotor, and which are concentric with the rotor, for the purpose of securing the performance of the compressor. When a vane tip contacts a terminal position of the arcuate part of the cam ring 3 in the rotational direction of the rotor, the bottom portion of the corresponding vane groove 27 is opened into the low-pressure port 33. Namely, when the vane 4 passes the arcuate part (during this time, the vane 4 is retracted in the rotor 5) of the cam ring 3 to project outward from the rotor 5, the internal pressure in the low-pressure port 33 is applied as a back pressure to the vane 4. Next, the low pressure port 33 terminates at a position at which communication is kept between the port 33 and the vane groove bottom portion of the vane 4 coming to the discharge port 19. The communication is described later. The focus will now be placed on the bottom portion of the vane groove 27. When the vane tip reaches the discharge port 19, the bottom portion of the corresponding vane groove is communicated with the high-pressure port 31 and separated therefrom in the starting position on the arcuate part of the cam ring 3 in the rotational direction of the rotor 5. The bottom portion of the vane groove 27 is not communicated with the low-pressure port 33 and high-pressure port 31 in the arcuate part of the cam ring 3, and it is communicated again with the low-pressure port 33 in a position which is immediately after the terminal position of the arcuate part of the cam ring 3. The low pressure ports 32 of the front plates are formed symmetrical of ones 33 of the rear front plate 2.

Figure 5:
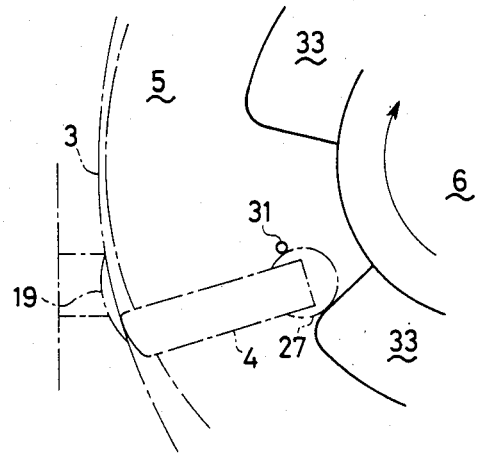
FIG. 5 is an enlarged plan view of the portion of the rear plate which is in the vicinity of a discharge port in the above embodiment.

A means for determining the pressure in the low-pressure ports in the present invention will now be described. FIG. 5 is an enlarged view of the rear plate 2, in which the vane 4 reaches the discharge port 19 provided in the cam ring 3. Referring to this drawing, the high-pressure port 31 and low-pressure port 33 are communicated with each other (in FIG. 5, the high-pressure port 31 and low-pressure port 33 are in contact with the bottom portion of the vane groove 27. This is simply an example of the communication between these ports 31 and 33. The communication relation between these 31, 33 is to be described later) via the bottom portion of the vane groove 27. Accordingly, the internal pressure in the low-pressure port 33 at this time is based on the pressure, the level of which is substantially equal to that of the discharge pressure in the compressor, in the high-pressure port which is introduced by the conveyance of the high pressure lubricating oil via the bottom portion of the vane groove 27. However, the pressure of the lubricating oil and any gas in the low-pressure port 33 decreases since the time for which the high-pressure port 31 and low-pressure port 33 are communicated with each other is short and since the pressure from the high-pressure port 31 passes practically through a gap between the rotor 5 and rear plate 2. When the rotor is then rotated clockwise in the drawing, so that the bottom portion of the vane groove 27 is removed from the low-pressure port 33, the communication between the low-pressure port 33 and high-pressure port 31 via the bottom portion of the vane groove 27 ceases, and the pressure in the low-pressure port 33 decreases gradually due to pressure leakage from the gap between the rotor 5 and rear plate 2.

Figure 6:
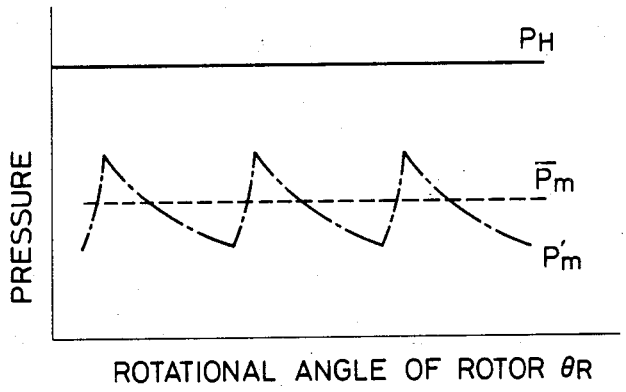
FIG. 6 is a theoretical curve showing the relation between the angle of rotation of the rotor and the pressures in the high-pressure port and low-pressure ports in the above embodiment.
Figure 7:
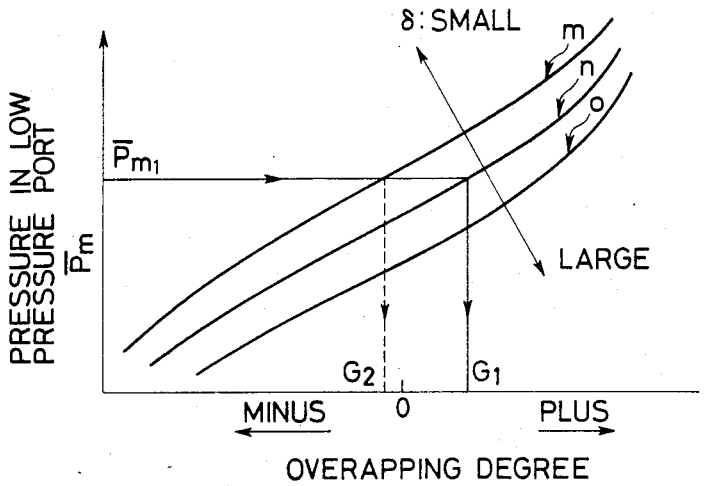
FIG. 7 illustrates the relation between the overlap degree and the internal pressure $\overline{P}m$ in the low-pressure port.
Figures 8A, 8B, 8C:
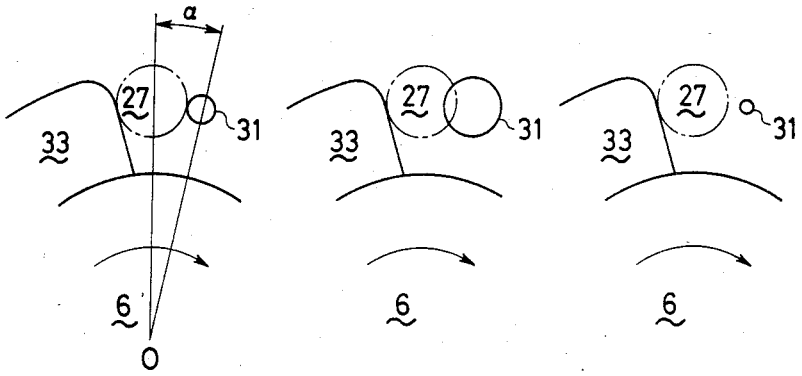
FIGS. 8A to 8C illustrate the overlap degrees.

The relation between the internal pressures in the high-pressure port 31 and low-pressure port 33 with respect to an angle $\theta R$ of rotation of the rotor 5 is shown in FIG. 6. The angle $\theta R$ is measured from the mid-point of the arcuate part. The internal pressure $P_H$ in the high-pressure port 31 is substantially constant with respect to $\theta R$, and the value thereof is substantially equal to that of the discharge pressure Pd in the compressor. The internal pressure in the low-pressure port 33 increases suddenly at the moment the high-pressure port 31 and low-pressure port 33 are communicated with each other via the bottom portion of the vane groove 27, and decreases gradually, as shown by a curve Pm' in FIG. 6, when the communication between these ports ceases, as described previously. This phenomenon is repeated (number of compression chambers)×(number of vanes)=10 times per revolution of the rotor. Accordingly, the substantial internal pressure in the low-pressure port 33 becomes $\overline{P}m$, an average of the above-mentioned pressure Pm', Namely, the internal pressure in the low-pressure port 33 in this embodiment is determined by the switching effect (ON-OFF operation) of the bottom portion of the vane groove 27, and an optimum value of this internal pressure can be obtained in accordance with the position and shape of the high-pressure port 31 and low-pressure port 33, and the gaps, for example, between the rotor 5 and cam ring 3, the end surface of the rotor 5 and front and rear plates 1, 2, and the end surface of the vane 4 and front and rear plates, which are determined by the performance and assemblability of the compressor. Thus, the low-pressure ports 32, 33 are formed as substantially closed pockets into which the lubricating oil enters only when the high pressure ports 31 and the low pressure ports 32, 33 are communicated with each other through the bottom portions of the vane grooves 27 and from which the lubricating oil leaks through the gaps as noted above. FIG. 7 shows the relation, which is determined when the discharge pressure, suction pressure and rotational speed of the compressor are at constant levels, between the relative positions (which will hereinafter be called overlap degree) of the low-pressure port 33, high-pressure port 31 and bottom portion of the vane groove 27 and the internal pressure $\overline{P}m$ in the low-pressure port 33 with the above-mentioned gap $\delta$ used as a parameter. A zero overlap degree shall represent a case where the low-pressure port 33 and high-pressure port 31 contact each other via the bottom portion of the vane 27 as shown in FIG. 8A, a plus overlap degree a case where the low-pressure port 33 and high-pressure port 31 are communicated with each other as shown in FIG. 8B, and a minus overlap degree a case where the low-pressure port 33 and high-pressure port 31 are not directly communicated with each other as shown in FIG. 8C. As may be noted from FIG. 7, $\overline{P}m$ decreases as the overlap degree varies from the plus degree to the minus degree and as $\delta$ increases. As previously mentioned, $\delta$ is determined by the performance and assemblability of the compressor. Accordingly, for example, when $\delta$ is (n), an overlap degree $G_1$ in which a desired $\overline{P}m=\overline{P}m_1$ is obtained is determined. When $\delta$ is (m), an overlap degree $G_2$ is determined for obtaining a desired $\overline{P}m$. FIGS. 8A to 8C show an example in which the overlap degree is varied by changing the diameter, which is to be designated by $D_H$, of the high-pressure port 31. In this example, the bottom portion of the vane 27, the diameter of which is to be designated by $D_B$, and high-pressure port 31 are formed circularly, and an angle $\alpha$ between a straight line connecting the axes of the bottom portion of the vane 27 and the driving shaft 6 and a straight line connecting the axes of the high-pressure port 31 and driving shaft 6 and $D_B$ are set at constant levels. The overlap degree-varying method is not limited to this method; any method may be used provided that it satisfies the conditions shown in FIGS. 8A to 8C for the overlap degree. For example, a method in which $\alpha$ is varied with $D_B$ and $D_H$ kept constant can also attain the overlap degree shown in FIGS. 8A to 8C.

Practically, gaps between the sides of the rotors and the front and rear plates 1, 2 are 40μ to 60μ (20 to 30μ at one side), the $\overline{P}m$ is about one half the discharge pressure PH, and the diameter of the high pressure port 31 is about 1 mm. The overlap degree is preferably minus, that is, the low pressure port 33 is separated from the bottom portion of the groove 27 contacting the high pressure port 31 by an angle of 0 to 2°-3° of rotation of the rotor 5. Therefore, in this case, the communication between the low pressure port 33 and the high pressure port 31 is effected by both the bottom portion of the vane groove 27 moving between the high pressure port 31 and the low pressure port 33 and the gaps between the rotor sides and the front and rear plates 1, 2.

A relationship between the low pressure port 32 and the high pressure port 31 is substantially the same as the relationship between the port 33 and the high pressure port 31.

Figure 9:
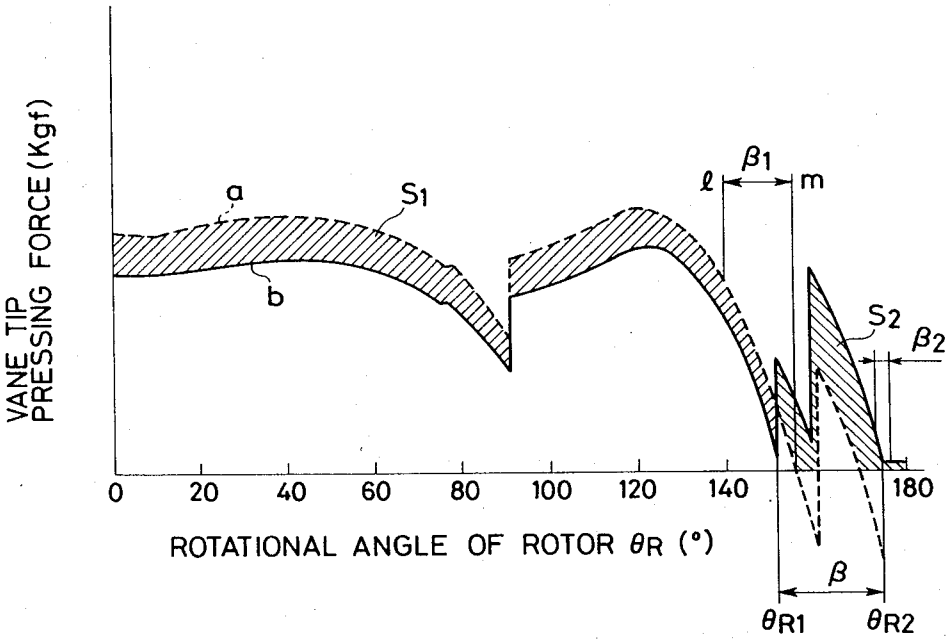
FIG. 9 is a graph showing the relation between the vane tip pressing force Ft and the angle $\theta R$ of rotation of the rotor.

FIG. 9 shows the relation between the vane tip-pressing force Ft and the angle $\theta R$ of rotation of the rotor 5, which is determined with the discharge pressure, suction pressure and rotational speed of the compressor set at constant levels.

Referring to FIG. 9, a curve a represents such relation in a conventional compressor of this kind which is similar to one described in the background of the invention, and a curve b the similar relation in this embodiment. The curve b indicates that the bottom portion of the vane 4 and high-pressure port 31 are communicated with each other when $\theta R = \theta R_1$, and shut off from each other when $\theta R = \theta R_2$. $\theta R_1$ is in the range $\beta_1$ which is between a point l, in which Ft decreases suddenly, on the curve and a point m, in which $Ft \leqq 0$, on the same curve, and $\theta R_2$ in the range $\beta_2$ which is in the vicinity of the starting position on the arcuate portion of the cam ring 3. Therefore, in the case represented by the curve b, Ft can be set s as to be larger than zero in the range of angle $\beta$ of rotation of the rotor, and chattering in this range can be prevented. When the angle of rotation of the rotor 5 is out of the range $\beta$, Ft can be set lower than in the case of the curve a, so that friction loss at the vane tip, which corresponds to $S_1$-$S_2$, can be reduced.

Figure 10:
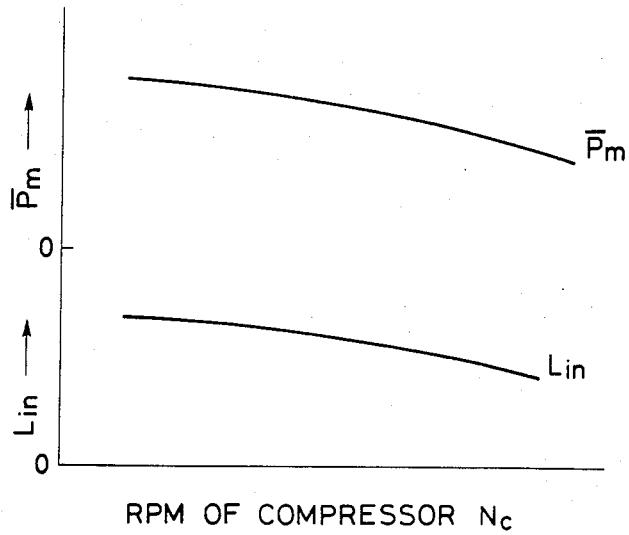
FIG. 10 is curves of experimental results, which show the relation between the rotational speed of the compressor of the above embodiment and the pressure in the low-pressure port and the shaft input in the compressor.

FIG. 10 shows curves of results of experiments, which represent the relation between the rotational speed (rpm) Nc of the compressor in this embodiment and the internal pressure $\overline{P}m$ in the low-pressure port 32, 33 and the torque $L_{IN}$ in the shaft 6 in the compressor, which relation is determined with the suction pressure and discharge pressure in the compressor set in constant levels. The curves show that $\overline{P}m$ decreases as Nc increases. When $\overline{P}m$ decreases, the vane tip-pressing force decreases, so that $L_{IN}$ also decreases. The possibility of minimizing $\overline{P}m$ in an operational region in which Nc is high serves to improve the total adiabatic efficiency of the compressor, reduce the temperature of the discharged gas and improve the abrasion resistance of the vane 4 and cam ring 3.

In this embodiment, the high-pressure port 31 is provided in the rear plate 2 because the high pressure-obtaining means, i.e. the lubricating oil, which is under a high pressure, in the bottom portion of the chamber 13 is close to the rear plate 2. In a compressor, in which such a chamber is provided on the side of a front plate, the high-pressure port 31 is necessarily in the front plate 1. In this embodiment, the bottom portion of the vane groove 27 is formed circularly; the shape of the bottom portion of the vane groove 27 is not limited to this. For example, it may be rectangularly formed provided that it has an effect which is as good as that in this embodiment.

Figure 11:
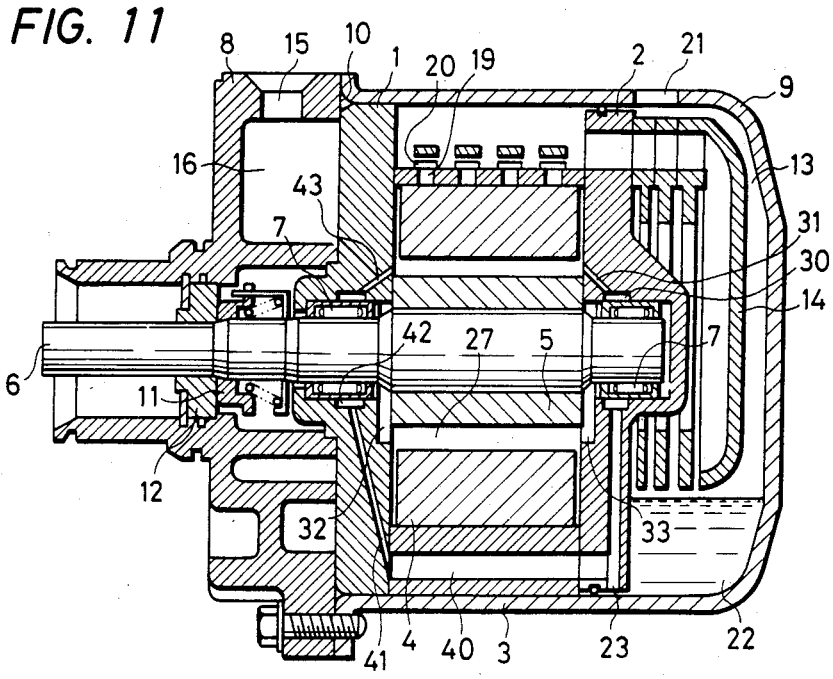
FIG. 11 is a sectioned side elevation of another embodiment of the present invention.

FIG. 11 shows another embodiment of the present invention. A front plate 1 is provided with a high-pressure oil supply passage 41 which is communicated with a lubricating oil 22 via an oil supply passage 40 made in a cam ring 3 and an oil supply passage in a rear plate 2. This oil supply passage 41 is opened into an annular communication passage 42 formed around the outer circumferential surface of a needle bearing 7. The front plate 1 is further provided with a high-pressure port 43 formed so as to be communicated with a communication passage 42. The construction of the other parts is identical with that of the corresponding parts of the embodiment shown in FIG. 1. Therefore, in the second embodiment, the lubricating oil under a high pressure is introduced into the high-pressure ports in the rear and front plates 2, 1, and the hydraulic pressure of the lubricating oil works on both side surfaces of the rotor 5 and vanes 4. This enables the force working on both side surfaces of the rotor 5 and vanes 4 to be offset.

Therefore, according to this embodiment, the positions of the rotor and vanes in the axial direction of the compressor can be maintained properly.

As described above, the present invention prevents chattering in the vicinity of the discharge port, and properly controls the vane back pressure with a simply-constructed means. Namely, according to the present invention, a compact vane back pressure control means can be formed, and the performance and abrasion resistance of the compressor can be improved.

What is claimed is:

1. A vane type compressor comprising:

a cam ring provided with delivery ports;

an operating chamber formed by said cam ring and rear and front plates which are provided so as to close both side surfaces of said cam ring, said front plate having suction ports;

a rotor, which has a plurality of outward and inward movable vanes and a plurality of grooves in which said vanes are fitted, and which is disposed in said operating chamber so that said rotor can be rotated coaxially with said cam ring;

a hollow space formed at the rear side of said rear plate and provided therein with a chamber for storing a lubricating oil which is under a discharge pressure;

high-pressure ports provided in the portions of at least one of said rear and front plates which are opposed to the bottom portions of the vane grooves positioned in the vicinity of said delivery ports; and low-pressure ports provided independently of said high-pressure ports in the portions of said rear and front plates which are opposed to said bottom portions of vane grooves, said high-pressure ports being communicated with said chamber, said low-pressure ports being substantially closed pockets communicated with said chamber only via said high-pressure ports and the bottom portions of the vane grooves positioned in the vicinity of said discharge ports only when the center of said vane grooves are positioned between said low-pressure ports and said high-pressure ports so that the lubrication oil in said chamber is intermittently fed to said low pressure ports as said rotor rotates thereby to produce pressure in said low pressure ports.

2. A vane type compressor comprising:

a cam ring with delivery ports and a cam face at the inner surface;

a pair of side plates in the form of a front plate and a rear plate fixed to sides of said cam ring and forming an operating chamber, one of said pair of side plates having suction ports;

a rotor disposed in said operating chamber and rotatably supported at a shaft thereof by said pair of side plates, said rotor having a plurality of vanes respectively inserted in a vane groove formed in said rotor so as to be movable outward and inward thereof;

a pressure chamber, provided out of said operating chamber and communicating with said delivery ports, for storing a lubrication oil, under substantially the same pressure as one of discharged fluid having passed through said delivery ports;

high pressure ports provided in at least one of said pair of side plates at such positions that a vane groove lower portion of one of said vanes which comes into a vicinity of one of said delivery ports as said rotor rotates starts to communicate with one of said high pressure ports, said high pressure ports communicating with said pressure chamber so that the lubricating oil under high pressure is introduced from said pressure chamber into said vane groove lower portions of said vanes in the vicinity of said delivery ports to increase a pressing force of the tip of said vane on said cam face; and low pressure ports each provided independently of and angularly spaced in a rotational direction of said rotor from said high pressure ports in said pair of side plates at positions corresponding to vane groove lower portions of said vanes, said low pressure ports being substantially closed pockets spaced from said high pressure ports such that they are brought into communication with said high pressure ports via said vane groove lower portions of said vanes in the vicinity of said high pressure ports only when centers of said vanes are angular positioned between said high pressure ports and said low pressure ports so that the lubrication oil is introduced from said high pressure chamber into said low pressure ports only via said high pressure ports and said vane groove lower portions, whereby pressure in said low pressure ports is established through switching operations of communication between said high pressure ports and said low pressure ports.

3. The vane type compressor as defined in claim 2, wherein each of said low pressure ports extends, in an arcuate region around the shaft, from about a position where one of said vanes begins to move outward in the vane groove to a position around a trailing side of a lower portion of a vane groove receiving one of said vanes coming to one of said high pressure ports.

4. The vane type compressor as defined in claim 3, wherein said high pressure ports and said low pressure ports are provided symmetrically with respect to the rotor shaft.

5. The vane type compressor as defined in claim 4, wherein a distance between each of said low pressure ports and each of said high pressure ports is substantially the same as the width of each vane groove lower portion.

6. The vane type compressor as defined in claim 4, wherein a distance between said low pressure ports and said high pressure ports is a little larger than the width of each vane groove lower portion such that the lubrication oil is introduced from said high pressure ports into said low pressure ports via said vane groove lower portions and gaps defined between said side plates and end faces of said rotor, thereby producing pressure in said low pressure ports.

7. The vane type compressor as defined in claim 2, wherein said high pressure ports are provided in both said front plate and said rear plate so as to be symmetrically positioned with respect to said cam ring.

8. A vane type compressor comprising:

a cam ring with delivery ports and a cam face at the inner surface;

a pair of side plates in the form of a front plate and a rear plate fixed to sides of said cam ring and forming an operating chamber, one of said pair of side plates having suction ports;

a rotor disposed in said operating chamber and rotatably supported at a shaft thereof by said pair of side plates, said rotor having a plurality of vanes each of which is inserted in a vane groove formed in said rotor to be movable outward and inward therein;

a pressure chamber, provided out of said operating chamber and communicating with said delivery ports, for storing a lubrication oil, under substantially the same pressure as one of discharged fluid having passed through said delivery ports;

high pressure ports each provided in at least one of said pair of side plates at a position where a vane groove lower portion of one of said vanes which comes into a vicinity of one of said delivery ports as said rotor rotates starts to communicate with said high pressure port communicating with said pressure chamber so that the lubrication oil under high pressure is introduced from said pressure chamber into said vane groove lower portion in the vicinity of said at least one delivery port through said high pressure port to increase a pressing force for the tip of said vane on said cam face; and substantially closed pocket-shaped low pressure ports provided independently of said high pressure ports in said pair of side plates at positions correspondig to vane groove lower portions of said vanes, each of said low pressure ports extending, in an arcuate region around said shaft, from about a position where one of said vanes begins to move outward in the vane groove to a position which is separated from the vane groove lower portion contacting said high pressure port by an angle of 0°–3° measured as a rotational angle of said rotor so that each said low pressure port is communicated with said high pressure port via said vane groove lower portion of said vane in a vicinity of said high pressure port only when centers of said vanes are angularly positioned between said high pressure port and said low pressure port so that said low pressure port is fed with lubrication oil from said pressure chamber only through switching operations of communication between said high pressure port said low pressure port whereby pressure in said low pressure port is established.

* * * * *